United States Patent [19]

Jinno

[11] 4,100,059

[45] Jul. 11, 1978

[54] ASPHALT RECYCLE SYSTEM

[76] Inventor: Michio Jinno, 6-3, Yasudadohri, Showa-ku, Nagoya-shi, Japan

[21] Appl. No.: 744,308

[22] Filed: Nov. 23, 1976

[30] Foreign Application Priority Data

| | | | |
|---|---|---|---|
| Dec. 11, 1975 | [JP] | Japan | 50-148246 |
| May 14, 1976 | [JP] | Japan | 51-55945 |
| May 17, 1976 | [JP] | Japan | 51-56317 |
| May 17, 1976 | [JP] | Japan | 51-56318 |
| May 17, 1976 | [JP] | Japan | 51-56319 |
| May 20, 1976 | [JP] | Japan | 51-57231 |

[51] Int. Cl.[2] ..... B03B 9/02

[52] U.S. Cl. ..... 209/3; 209/11; 209/238; 106/280; 106/281 R; 106/283

[58] Field of Search ..... 209/11, 173, 238, 173; 106/281 R, 283, 280; 404/80, 79, 77; 259/155-159 R; 208/39

[56] References Cited

U.S. PATENT DOCUMENTS

| | | | |
|---|---|---|---|
| 505,416 | 9/1893 | Bell | 209/173 X |
| 1,456,492 | 5/1923 | Hepburn | 106/283 |
| 2,413,908 | 1/1947 | Chester | 259/156 X |
| 2,459,520 | 1/1949 | Greenshields | 106/283 |
| 3,305,474 | 2/1967 | Knowles et al. | 106/283 X |
| 3,984,920 | 10/1976 | Raymond et al. | 209/11 X |
| 4,000,000 | 12/1976 | Mendenhall | 106/281 R X |

FOREIGN PATENT DOCUMENTS

| | | | |
|---|---|---|---|
| 891,731 | 3/1962 | United Kingdom | 259/156 |

*Primary Examiner*—Frank W. Lutter
*Assistant Examiner*—Ralph J. Hill
*Attorney, Agent, or Firm*—Lane, Aitken, Dunner & Ziems

[57] ABSTRACT

Steam is injected into water to regenerate asphalt waste which is heated in the water to a predetermined temperature. Such heated asphalt waste is mechanically subdivided in the water into aggregate grains each having its surface coated with a thin asphalt film.

5 Claims, 5 Drawing Figures

ASPHALT RECYCLE SYSTEM

BACKGROUND OF THE INVENTION

This invention relates to an asphalt recycle system.

The conventional asphalt used for pavement has been normally thrown away as the waste in road repairs. However, such disposal of asphalt waste involves not only economical loss but also environmental pollution. Furthermore, the transportation of the waste consumes considerable time and cost. It is also unfavored from the standpoint of nursing resources which is presently a world-wide problem.

The recycling or regenerative methods proposed in the past include those involving heating the waste with high-frequency waves or directly with flame; that of exposing the waste to steam; that of indirectly heating the waste with high-temperature oil; and that of crushing.

SUMMARY OF THE INVENTION

An object of the present invention is to provide an asphalt recycle system of high practicability which can produce a asphalt of high quality.

In a preferred embodiment of the invention, steam is injected into water to regenerate the asphalt waste . To wit, one of the essential features of the present invention resides in the jetting of steam into water, thereby heating the asphalt waste in the presence of water.

According to the invention, the asphalt waste is immersed in water during both the heating and the subdividing. This is an important feature of the invention. Use of steam also is an important feature, but it can achieve the expected effect only when used in combination with the water. Therefore, the system is based on a fundamentally different principle from that of a recovery system in which the waste is heated in an atmosphere of steam. Again, while various heating media are known, high-temperature steam is used in the invention to heat the asphalt waste in the water.

In practicing the method of this invention, the asphalt waste as torn off from the paved road can be treated. In other words, sorting or washing of the waste pieces is unnecessary. This is a great advantage of the present invention. If a preliminary sorting or washing of the material is required before the regenerative treatment, particularly when enormous volume of the waste is to be treated, the loss in time and cost would be very severe.

Again according to the invention, because the asphalt waste is subdivided as softened and immersed in the water, the aggregate does not adhere to the separation tank or to other aggregates.

Furthermore, the subdivision of the asphalt waste as softened and immersed in the water produces another advantage in that the individual aggregate grains are separated but the individual grains are not broken. This is very important, particularly in relation to the strength. As well known, the shape or configuration of the aggregate is an important factor in obtaining the predetermined strength of asphalt concrete. For this reason an asphalt recycle system which destroys the aggregates, such as the crushing method, is not practical. According to the invention the aggregates are simply separated into individual pieces while retaining the original shapes, and is free of the problem of strength deterioration.

DESCRIPTION OF THE PREFERRED EMBODIMENTS

Figure 1:
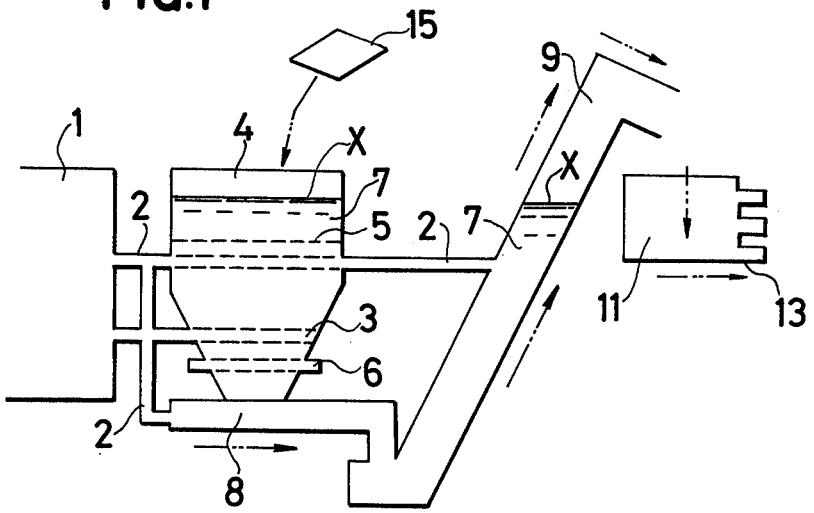
FIG. 1 is a schematic vertical view of a asphalt recycle system according to the present invention.

According to the invention, first the heated steam is jetted into the water in a tank, and the asphalt waste is immersed and heated to a predetermined temperature. Normally preferred temperature level ranges from 80° C to 100° C under atmospheric pressure, particularly approximately 90° C. (Obviously the temperature may vary with a highly pressurized atmosphere or under other unusual ambient conditions.) Thus heated asphalt waste is subdivided by a suitable mechanical means while immersed in the water. For example, the asphalt waste is immersed in the water in the tank and heated at 80° - 100° C for approximately 20 minutes, and subdivided into individual grains in the water by means of, for example, a screw.

The mixture resulted from the subdivision according to the invention consists of many aggregrate grains each having its surface coated with a thin asphalt film. The sizes of the aggregates depend on those of the asphalt waste initially thrown into the water. They may be uniform or varied. The asphalt coating on the surfaces of a grain of the asphalt waste possesses strong adhesion to that particular grain, but exhibits no adhesion to other aggregate grains or to the asphalt coatings on their surfaces. Therefore, the great number of aggregate grains each having the asphalt-coated surfaces are loose and mobile independently of each other. Consequently, they can be very easily sorted with sieves into the desired number of sized groups if necessary.

The asphalt coating on the aggregates' surfaces may contain a minor amount of an active substance. Preferably the amount of such an active substance should range 5 to 20% of the asphalt coating by weight ratio, inter alia, approximately 10%. (The ratio may be varied depending on the intended utility of the product, type and dimensions of the aggregate, specific type of the asphalt, etc.) While various active substances may be used, preferably active terra alba and active carbon are concurrently employed. It has been experimentally confirmed that favorable results can be obtained when the active component is composed of approximately 80 - 95% of active terra alba and approximately 20 - 5% of active carbon. The optimum results can be obtained, furthermore, when 90% of active terra alba and 10% of active carbon are used, although the results are to some extent dependent also on other conditions of use. The active substance may be put into the water in the tank before introduction of the asphalt waste.

The asphalt coating may furthermore contain a chalk. The suitable chalk content is widely variable depending on the intended utility of the product, but normally it is favored to use approximately the same amount of chalk as asphalt.

The mixture of the asphalt-coated aggregates of various grain sizes can be put to various usages as it is, but the field of its application can be still broadened when it is sorted into plural groups of approximately uniform grain sizes. For instance, the mixture may be divided with sieves into four size groups to be put to four separate usages as follows:

(a) the grains having the diameters ranging from 20 mm to 13 mm;
(b) those of 13 mm to 5 mm;
(c) those of 5 mm to 2.5 mm; and
(d) those having the diameters less than 2.5 mm.

It is also possible to blend the aggregates of those size groups in a suitable blend ratio.

Hereinafter some of the embodiments of this invention will be explained with reference to the attached drawings.

First referring to FIG. 1, inside a tank 4 a sheet of wire net 5, steam pipe 3, and a grinder 6 are installed. The wire net 5 and the grinder 6 may be omitted if so desired. At the bottom of the tank 4, a means for transfer, for example, screw 8, is connected. The screw 8 can function also as the means for comminution, enabling the asphalt to be sufficiently subdivided without the grinder 6. The screw 8 is also connected to the lower end of a hot elevator 9. A means for selection or sorting, for example, a shaking sieve 11, is located in a position to receive the asphalt waste dropped from the upper end of the elevator 9. The sieve 11 is provided with pipes 13. The steam pipes 2 from the boiler 1 are connected respectively to the tank 4, hot elevator 9 and the screw 8, each containing a perforated steam pipe 3. The tank 4 and the hot elevator 9 are filled with water to the predetermined level X. Into the water in the tank 4, heated steam is jetted through the apertures in the steam pipe 3.

The blocks of asphalt waste 15 are thrown into the tank 4 from the top, which can be efficiently accomplished with a shovel-dozer. The blocks are first roughly sorted by the wire net 5. In the embodiment illustrated by FIG. 1, the water level X in the tank 4 is set above the wire net 5. Heated steam is jetted into the water in tank 4 from the boiler 1, through the steam pipes 2 and 3, to raise the temperatute of the system to an appropriate level, for example, 90° C. The thus heated asphalt waste is subdivided into aggregates with the grinder 6 and/or screw 8. The thus obtained aggregates are sent to the shaking sieve 11 by means of the hot elevator 9, and thereby sorted into the desired number of groups according to their grain sizes.

The thus sorted aggregates are mixed with a volatile liquid and an emulsifier to provide regenerated asphalt blocks (room temperature asphalt blocks). It is also possible to obtain a regenerated asphalt mixture by heating the sorted aggregates. Thus the asphalt waste can be regenerated and re-used for the conventional road-paving.

Figure 3:
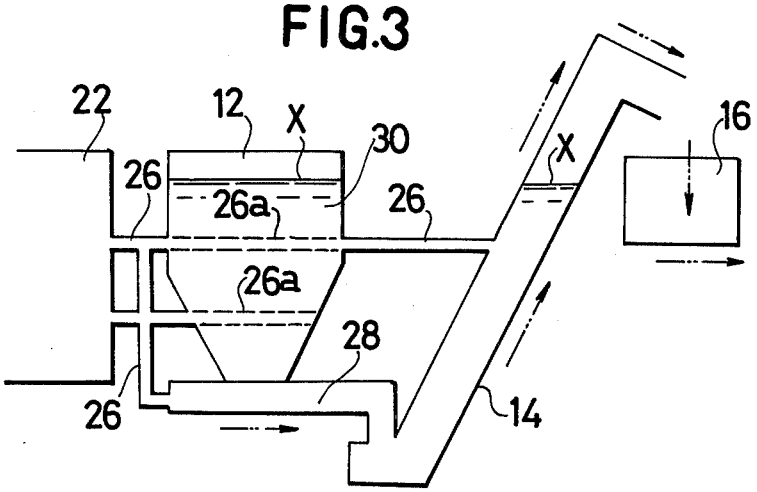
FIG. 3 is a schematic vertical view of a part of the asphalt recycle system shown in FIG. 2.

Now another embodiment of the asphalt waste recycle system according to the invention will be explained, referring to FIGS. 2 and 3.

Figure 2:
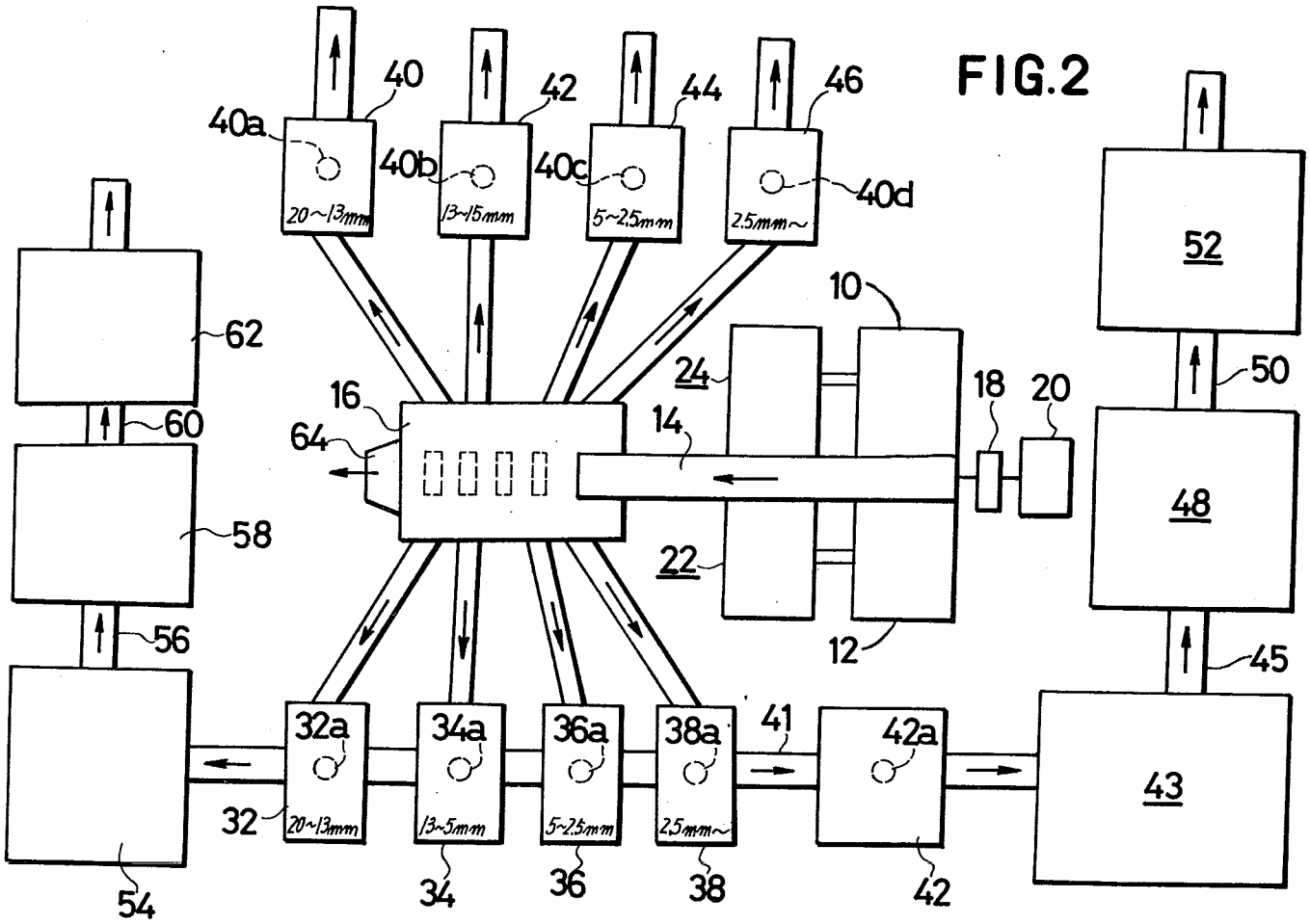
FIG. 2 is a plan view of another asphalt recycle system according to the present invention.

Although two tanks 10 and 12 are shown in FIG. 2, the number of tanks is optional. That is, a single tank or more than two tanks may be used as desired for a particular occasion. The tanks 10 and 12 are connected to the hot elevator 14, the other end of the elevator 14 leading to a screen sheet 16. The tanks 10 and 12 are also connected to the drive 18 which is controlled by the regulating means 20. The tank 10 is connected to a boiler 24 so that a high-pressure and high-temperature steam may be sent into the tank. Similarly the tank 12 is connected to the boiler 22 for receiving high-pressure and high-temperature steam. The boilers may be combined into one.

The important features of the above-described construction will be explained in further detail referring to FIG. 3. The boiler 22 is provided with plural pipes 26, a number of which are connected to the hot elevator 14, and to the inside of the tank 12. The pipe **26*a* in the tank 12 is perforated, and through the many orifices the hot steam is injected into the water. At the bottom of tank 12 a comminution means 28 is installed. The comminution means 28 used in this embodiment is a screw, and the comminution is effected as the material under treatment moves from the left to right in the drawing. The tank 12 is filled with water 30 to the level X. The hot elevator 14 is connected to the tank 12 by the pipe 26. The water level X is common between the tank 12 and hot elevator 14. From above the tank 12 the asphalt waste blocks are thrown into the tank and heated to the predetermined temperature in the water. Then the blocks are transferred to the right in the drawing while being broken into individual aggregate grains by the action of screw 28. The thus obtained aggregates lifted upward by the hot elevator 14 and transferred into the sorting means 16** (for example, a screen) to be sorted into plural size groups.

In this embodiment also a suitable temperature for the water ranges from 80° C. to 100° C., particularly about 90° C. (The temperature is variable under special ambient conditions such as highly elevated pressure.)

Incidentally the separation means 28 is not limited to the screw type. The sorting or screening means 16 is preferably so designed that the same can sort the aggregate grains into four groups according to their diameters, respectively ranging (a) 20 mm – 13 mm (b) 13 mm – 5 mm (c) 5 mm – 2.5 mm and (d) less than 2.5 mm. Obviously, sorting in different manner is perfectly acceptable as occasion demands.

Referring back to FIG. 2, each of the size groups sorted by the screening means 16 (to wit, the aggregate grains each having the surfaces coated with an asphalt film but which exhibit no adhesiveness to each other) is sent to its respective feeder hopper. For example, the grains of the diameters ranging from 20 mm to 13 mm are sent to the feeder hopper 32. Those of the diameters ranging from 13 mm to 5 mm are sent into the feeder hopper 34; those of 5 mm to 2.5 mm, to the feeder hopper 36; and those of less than 2.5 mm, to the feeder hopper 38. Similarly, the feeder hoppers 40, 42, 44 and 46 are provided to collect the aggregate grains of the diameters, respectively, ranging from 20 mm – 13 mm, 13 mm – 5 mm, 5 mm – 2.5 mm, and less than 2.5 mm. The feeder hoppers 32, 34, 36 and 38 are provided with a conveyor 41 in common, which is movable to either right or left by the signal given by the controlling means 20. The conveyor 41 is also connected to a reserve feeder hopper 42 which is to accommodate any suitable mixture. Obviously, more than one reserve feeder hopper may be installed if necessary. At one end of the conveyor 41, a room-temperature dry asphalt blending means 43 is installed, which is further connected to a room-temperature pug mill mixer 48 through the conveyor 45. The mixer 48 in turn is connected to a room-temperature asphalt storing means 52, through the conveyor 50. Any desired amount of the room-temperature asphalt can be suitably taken out of the storing means 52 as the occasion demands. A hot dry asphalt blending means 54 is located at the other end of the conveyor 41. The dry asphalt blending means 54 is connected to a dry mixer 58 through a conveyor 56, and the dry mixer 58 is connected to a surge tank 62 through a conveyor 60. The hot asphalt mixture can be suitably taken out of the surge tank 62 as the occasion demands. The aggregate of the grain sizes greater than 20 mm is withdrawn in the direction of the arrow marked 64.

Futhermore, the feeder hoppers 32, 34, 36 and 38 are each provided with a valve, respectively, 32*a*, 34*a*, 36*a* and 38*a*. By controlling those valves with the controlling means 20, the blend ratio of the asphalt mixture can be freely selected. Also the feeder hoppers 40, 42, 44 and 46 can provide each the asphalt mixture of uniform grain size, and have the valves 40*a* – 46*a*.

Yet another embodiment of the invention will now be explained with reference to FIGS. 4 and 5.

Figure 4:
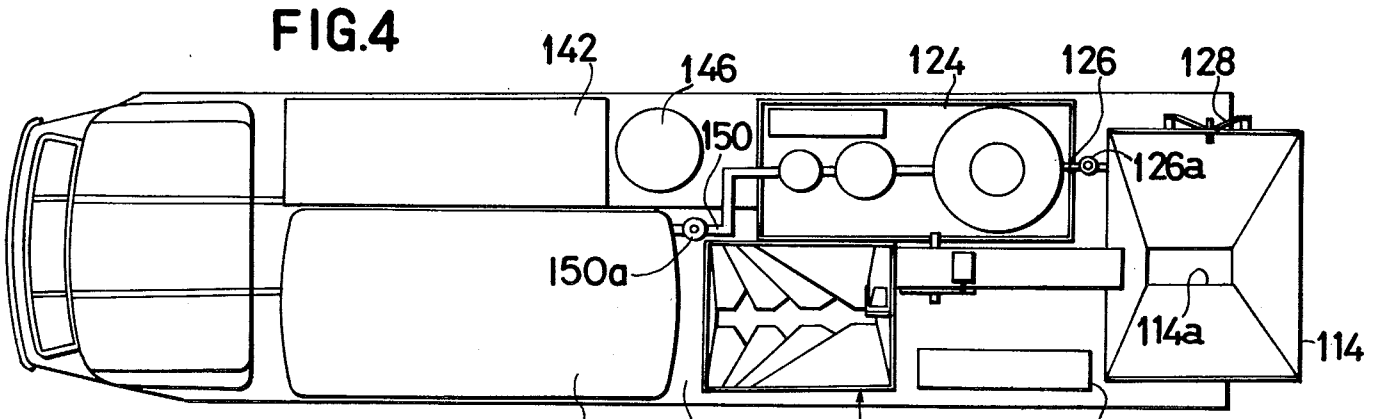
FIG. 4 is a schematic plan view of still another asphalt recycle system according to the present invention.
Figure 5:
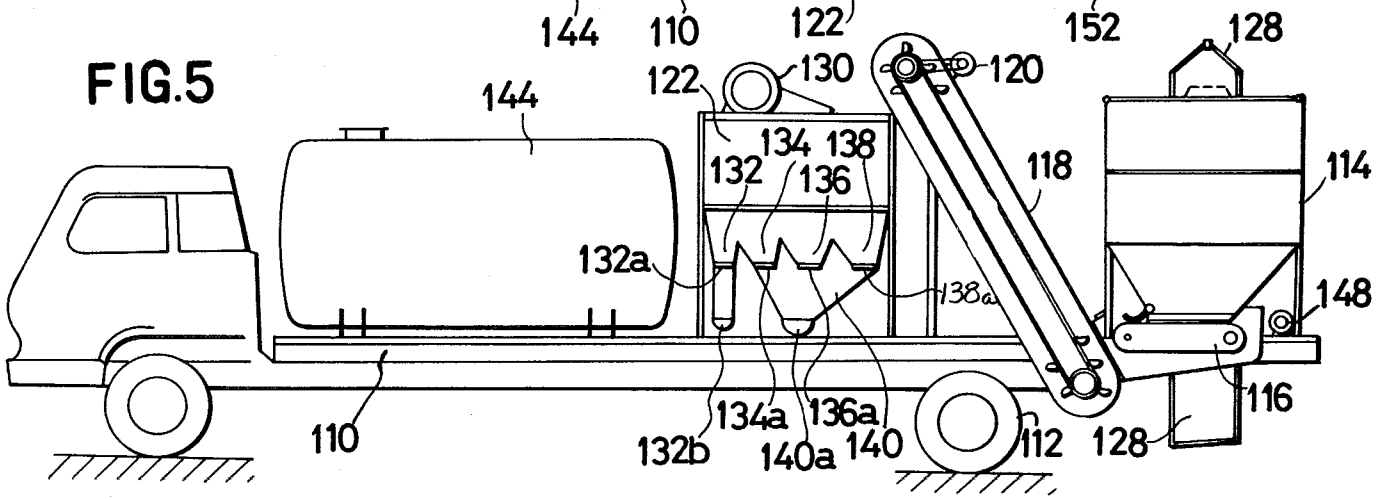
FIG. 5 is a side view of the system shown in FIG. 4.

Referring to FIG. 4, 110 is a platform or base mobile on wheels 112. In the illustrated embodiment, the system is run as a motor truck, the driver's seat being positioned at the left side. At the right of the driver's seat in FIG. 4, that is, behind the seat, the base 110 is disposed, and the seat portion and the base portion are integrated. If required, however, the base 110 may be separated from the driver's seat or the driving portion by employing a trailer system or any other suitable system.

The treating tank 114 is mounted on the base 110, which is so constructed that it can contain water to a predetermined level. At the lower portion of the tank 114 a comminution means 116 is provided. The specific type of the comminution means 116 is not critical, but in the embodiment shown, a screw is employed. The comminution means 116 is connected to a transportation means 118 which is a bucket-type elevator in the embodiment shown. The transportation means 118 is extended from the position of the separation means 116 to that above the treating tank 114, disposed with a slight inclination. The transportation means 118 is driven by the motor 120. A sorting means 122 is located at the forward end of the transportation means 118.

The treating tank 114 is connected to a boiler 124 through the pipe 126 as shown in FIG. 4, so that the water in the tank 114 filled to the predetermined level is heated to the predetermined temperature by the steam from the boiler 124. Since the type of the boiler 124 is not critical, and the boiler itself is not novel no detailed description of the boiler will be given. The feed to the boiler is controlled by valve 150*a* in line 150 and the steam flow by valve 126*a* in line 126.

The top of the treatment tank 114 has an opening 114*a*, which allows entry of the asphalt waste to be treated. Obviously, an optional design change such as closing the top and providing an entrance in another portion of the tank, is perfectly allowable.

In the embodiment shown, the top of the treating tank 114 is open, and the asphalt waste blocks are lifted up to the opening 114*a* by the elevator 128, to be automatically dropped into the water in the tank. If the elevator 128 is not used, the asphalt waste blocks may be directly thrown into the tank from the opening 114*a* by other means, for example, a shovel-dozer. The asphalt mixture to be treated is placed in the tank 114, and therein heated to the predetermined temperature by the water which has been heated to the predetermined temperature by the steam from the boiler 124. The asphalt mixture thus softened by heat is disengaged by comminuting means 116, while moving leftward (in the drawing). After the comminution treatment, the aggregate grains are sent to the sorting means 122 by the transportation means 118.

An example of the sorting means 122 will now be explained more specifically. In the embodiment shown, a shaking screen is used as the sorting means 122. The screen sieve is shaken as driven by the motor 130 and simultaneously moved from the right to left in the drawing, whereby sorting the material under treatment. In the specific embodiment, the material is sorted into four groups according to the grain sizes. Below the sorting means 122, four guide members 132, 134, 136 and 138 are disposed to guide, respectively, the grains of the diameters ranging from 20 mm to 13 mm, from 13 mm to 5 mm, from 5 mm to 2.5 mm, and less than 2.5 mm. The guide members 132, 134, 136 and 138 are provided respectively with the valves 132*a*, 134*a*, 136*a*, and 138*a*. By the suitable control of the valves the blend ratio of the asphalt mixture can be varied as desired. Also the three guide members 134, 136 and 138 are combined into one by the guide member 140. Incidentally, 132*b* is the exit from the guide member 132, and 140*a*, the exit from the guide member 140.

The base 110 is furthermore provided with the power source 142, water tank 144, and a fuel tank 146. The power source 142 is to drive the necessary motors, and for this purpose is connected to the motor 130 and motor 148 (for driving the comminution means 116). The water tank 144 is connected to the boiler 124 through the pipe 150, as well as to the treating tank 114. The fuel tank 146 is installed to supply fuel to run the boiler 124.

The above-described apparatus may be manually operated, but in the embodiment as shown they are automatically operated by the control device 152. The operation of the control device 152 and the individual parts is not shown, but all the connections are electrical. Obviously, it is allowable to run some parts by automatic control and the rest manually. It is left optional to the user's choice.

What is claimed is:

1. An asphalt recycling method comprising the steps of:

a. introducing 1) asphalt waste and 2) activated terra alba, activated carbon or a mixture thereof into a tank of water;

b. jetting steam into said water to heat said water to a temperature sufficient to soften the asphalt waste; and c. mechanically subdividing the asphalt waste while immersed in the heated water into aggregate grains, each aggregate having a surface coated with a thin asphalt film.

2. The method of claim 1 further comprising sorting said aggregate grains into a predetermined number of size groups.

3. The method of claim 1 wherein component 2 in step *a* is a mixture composed of approximately 80–95% active terra alba and approximately 5–20% active carbon.

4. The method of claim 1 wherein said asphalt waste is heated within said water to a temperature within the range of approximately 80° C to 100° C.

5. The method of claim 4 additionally comprising sorting said aggregate grains into a predetermined number of size groups.

* * * * *